US011078811B2

(12) United States Patent
Andrisani

(10) Patent No.: US 11,078,811 B2
(45) Date of Patent: Aug. 3, 2021

(54) APPARATUS FOR ACTUATING A LATCHING ARRANGEMENT

(71) Applicant: Eaton Intelligent Power Limited, Dublin (IE)

(72) Inventor: Nicola Andrisani, Cumiana (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/769,613

(22) PCT Filed: Dec. 10, 2018

(86) PCT No.: PCT/EP2018/084114
§ 371 (c)(1),
(2) Date: Jun. 4, 2020

(87) PCT Pub. No.: WO2019/110842
PCT Pub. Date: Jun. 13, 2019

(65) Prior Publication Data

US 2020/0318501 A1 Oct. 8, 2020

(30) Foreign Application Priority Data

Dec. 8, 2017 (GB) ..... 1720506

(51) Int. Cl.
*F01L 1/18* (2006.01)
*F01L 1/04* (2006.01)
*F01L 1/46* (2006.01)

(52) U.S. Cl.
CPC ..... *F01L 1/185* (2013.01); *F01L 1/04* (2013.01); *F01L 1/46* (2013.01)

(58) Field of Classification Search
CPC ..... F01L 1/185; F01L 1/04; F01L 1/46; F01L 13/0005; F01L 13/0036; F01L 2001/186; F01L 2820/031; F01L 13/00
See application file for complete search history.

(56) References Cited

U.S. PATENT DOCUMENTS

2010/0139594 A1 6/2010 Neukirchner et al.
2017/0198613 A1* 7/2017 Raimondi ..... F01L 1/14

FOREIGN PATENT DOCUMENTS

JP 2017186989 A 10/2017
WO WO 2017144706 A1 8/2017
WO WO 2017182631 A1 10/2017

* cited by examiner

*Primary Examiner* — Zelalem Eshete
(74) *Attorney, Agent, or Firm* — Leydig, Voit & Mayer, Ltd.

(57) ABSTRACT

An apparatus for actuating one or more latching arrangements of one or more respective rocker arms of a valve train assembly of an internal combustion engine, each rocker arm comprising a first body, a second body for pivotal motion with respect to the first body, and the latching arrangement, the latching arrangement latching and unlatching the first body and the second body, the includes: a shaft rotatable by an actuation source, from a rest orientation, in a first direction, and rotatable by the actuation source, from the rest orientation, in a second direction opposite the first direction; one or more selector cams rotatable by the shaft, each selector cam actuating the latching arrangement of a respective rocker arm so as to latch and/or unlatch the first body and the second body; and a return apparatus for returning the shaft to the rest orientation.

19 Claims, 5 Drawing Sheets

APPARATUS FOR ACTUATING A LATCHING ARRANGEMENT

CROSS-REFERENCE TO PRIOR APPLICATIONS

This application is a U.S. National Phase application under 35 U.S.C. § 371 of International Application No. PCT/EP2018/084114, filed on Dec. 10, 2018, and claims benefit to British Patent Application No. GB 1720506.3, filed on Dec. 8, 2017. The International Application was published in English on Jun. 13, 2019 as WO 2019/110842 under PCT Article 21(2).

FIELD

The present invention relates an apparatus for actuating a latching arrangement of a rocker arm of a valve train assembly of an internal combustion engine.

BACKGROUND

Internal combustion engines may comprise switchable engine or valve train components. For example, valve train assemblies may comprise a switchable rocker arm to provide for control of valve actuation (for example exhaust valve actuation and/or de-actuation) by alternating between at least two or more modes of operation (e.g. valve-lift modes). Such rocker arms typically involve multiple bodies, such as an inner arm and an outer arm. These bodies are latched together to provide one mode of operation (e.g. a first valve-lift mode) and are unlatched, and hence can pivot with respect to each other, to provide a second mode of operation (e.g. a second valve-lift mode). Typically, a moveable latch pin is used and actuated and de-actuated to switch between the two modes of operation.

SUMMARY

In an embodiment, the present invention provides an apparatus for actuating one or more latching arrangements of one or more respective rocker arms of a valve train assembly of an internal combustion engine, each rocker arm comprising a first body, a second body for pivotal motion with respect to the first body, and the latching arrangement, the latching arrangement being configured to latch and unlatch the first body and the second body, the apparatus comprising: a shaft rotatable by an actuation source, from a rest orientation, in a first direction, and rotatable by the actuation source, from the rest orientation, in a second direction opposite the first direction; one or more selector cams rotatable by the shaft, each selector cam being configured to actuate the latching arrangement of a respective rocker arm so as to latch and/or unlatch the first body and the second body; and a return apparatus configured to return the shaft to the rest orientation, the return apparatus comprising: one or more radial protrusions protruding radially out from the shaft; a reaction body; and a biasing means configured to contact the reaction body and the one or more radial protrusions, wherein the return apparatus is configured such that, in use: when the shaft is in the rest orientation the biasing means is configured to apply substantially no rotational force to the shaft, when the shaft is rotated from the rest orientation in the first direction the biasing means is configured to contact the reaction body and one or more of the radial protrusions so as to bias the shaft rotationally in the second direction to towards the rest orientation, and when the shaft is rotated from the rest orientation in the second direction the biasing means is configured to contact the reaction body and one or more of the radial protrusions so as to bias the shaft rotationally in the first direction to towards the rest orientation.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
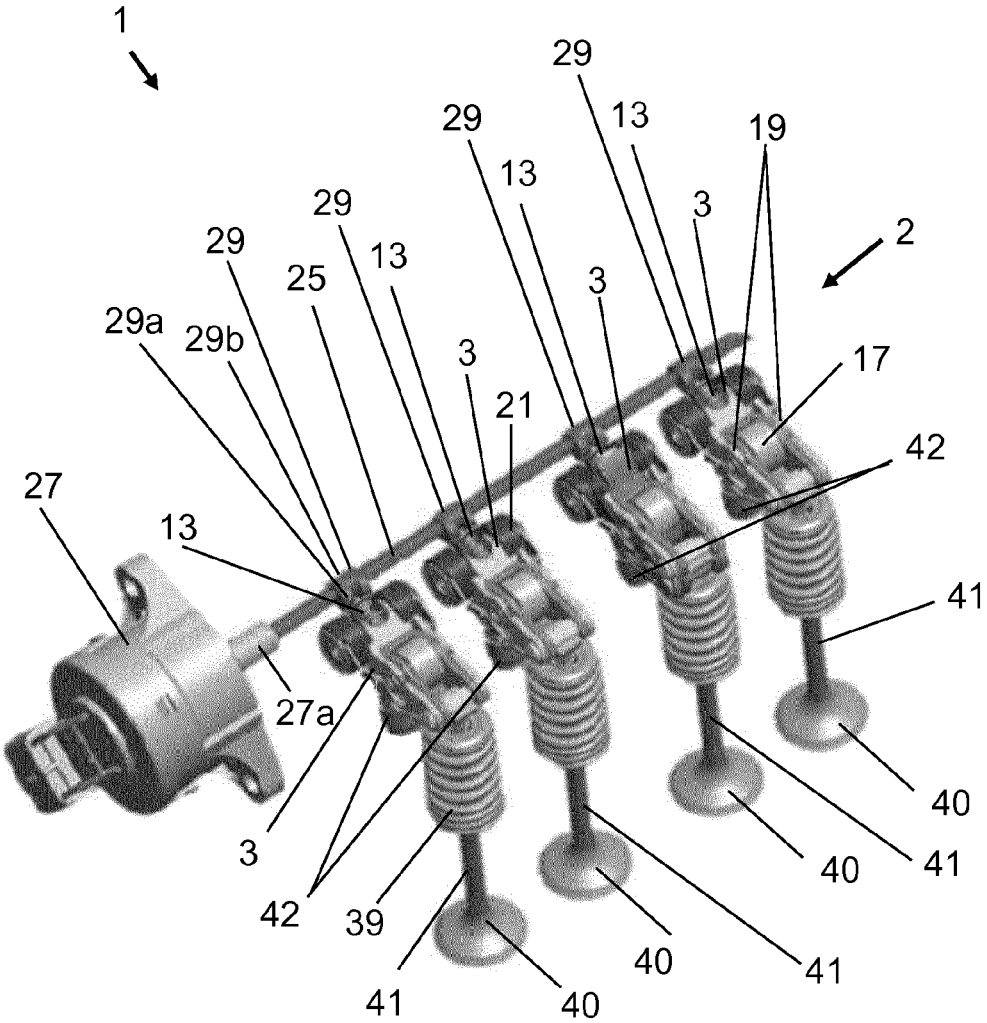
FIG. 1 illustrates schematically a perspective view of a portion of valve train assembly according to an example.

In an embodiment, the present invention provides an apparatus for actuating one or more latching arrangements of one or more respective rocker arms of a valve train assembly of an internal combustion engine, each rocker arm comprising a first body, a second body for pivotal motion with respect to the first body, and a said latching arrangement, the latching arrangement being for latching and unlatching the first body and the second body, the apparatus comprising: a shaft rotatable by an actuation source, from a rest orientation, in a first direction, and rotatable by said actuation source, from the rest orientation, in a second direction opposite to the first direction; one or more selector cams rotatable by the shaft, each selector cam for actuating the latching arrangement of a respective rocker arm so as to latch and/or unlatch the first body and the second body; and return apparatus for returning the shaft to the rest orientation, the return apparatus comprising: one or more radial protrusions protruding radially out from the shaft; a reaction body; and a biasing means arranged for contacting the reaction body and for contacting the one or more radial protrusions; wherein the return apparatus is arranged such that, in use, when the shaft is in the rest orientation the biasing means applies substantially no rotational force to the shaft, when the shaft is rotated from the rest orientation in the first direction the biasing means contacts the reaction body and one or more of the radial protrusions so as to bias the shaft rotationally in the second direction to towards the rest orientation, and when the shaft is rotated from the rest orientation in the second direction the biasing means contacts the reaction body and one or more of the radial protrusions so as to bias the shaft rotationally in the first direction to towards the rest orientation.

The return apparatus may be arranged such that when the shaft is in the rest orientation the biasing means abuts the reaction body such that the biasing means applies substantially no net force to the shaft through the one or more radial protrusions.

The return apparatus may be arranged such that when the shaft is in the rest orientation the biasing means abuts the one or more radial protrusions such that the biasing means applies substantially no net force to the reaction body.

The shaft may comprise the one or more selector cams.

The shaft may be a drive shaft of a said actuation source.

The biasing means may comprise a torsional biasing means.

The torsional biasing means may be arranged around the shaft, and a first end portion of the torsional biasing means may be for contacting the reaction body and at least one of the radial protrusions, and a second end portion of the torsional biasing means may be for contacting the reaction body and the at least one or another of the radial protrusions.

The reaction body may comprise a reaction member located intermediate of the first end portion of the torsional biasing means and the second end portion of the torsional biasing means.

The apparatus may be arranged such that when the shaft is in the rest orientation the first end portion of the torsional biasing means and the second end portion of the torsional biasing means abut the reaction member such that the torsional biasing means applies substantially no force to the one or more radial protrusions.

A thickness of the reaction member in a plane perpendicular to the axis of the shaft may be substantially equal to or greater than a thickness of the one or more radial protrusions in a plane perpendicular to the axis of the shaft.

The biasing means may comprise a first biasing element and a second biasing element separate from the first biasing element, the first biasing element and the second biasing element each being for contacting the reaction body and for contacting the one or more radial protrusions such that, in use, when the shaft is rotated from the rest orientation in the first direction the first biasing element applies a force to one or more of the radial protrusions so as to bias the shaft rotationally in the second direction to towards the rest orientation, and when the shaft is rotated from the rest orientation in the second direction the second biasing element applies a force to one or more of the radial protrusions so as to bias the shaft rotationally in the first direction to towards the rest orientation.

The one or more radial protrusions may be located intermediate of the first biasing element and the second biasing element.

The reaction body may comprise a reaction member located intermediate of the first biasing element and the second biasing element.

The apparatus may be arranged such that when the shaft is in the rest orientation the first biasing element and the second biasing element abut the reaction member such that both the first biasing element and the second biasing element apply substantially no rotational force to the shaft.

The reaction member may be arranged such that a separation, in a plane perpendicular to the axis of the shaft, between the first biasing element and the second biasing element when the shaft is in the rest orientation is substantially equal to or greater than a thickness of the one or more radial protrusions in a plane perpendicular to the axis of the shaft.

The first biasing element and the second biasing element may each comprise a pad for contacting the one or more radial protrusions and for contacting the reaction member, wherein when the shaft is in the rest orientation, the reaction member extends only part way across the pad of each biasing element, and the one or more radial protrusions extend only part way across the pad of each biasing element.

The apparatus may comprise a plurality of said selector cams, each for actuating the latching arrangement of a respective different said rocker arm of a plurality of said rocker arms.

Each of the plurality of selector cams may have a different shape so as to allow control of said latching arrangements on a per rocker arm basis.

In an embodiment, the present invention provides a valve train assembly for an internal combustion engine, the valve train assembly comprising: the apparatus described above; a said actuation source; and a said rocker arm or said plurality of rocker arms.

In the following, like reference signs denote like features.

Figure 2:
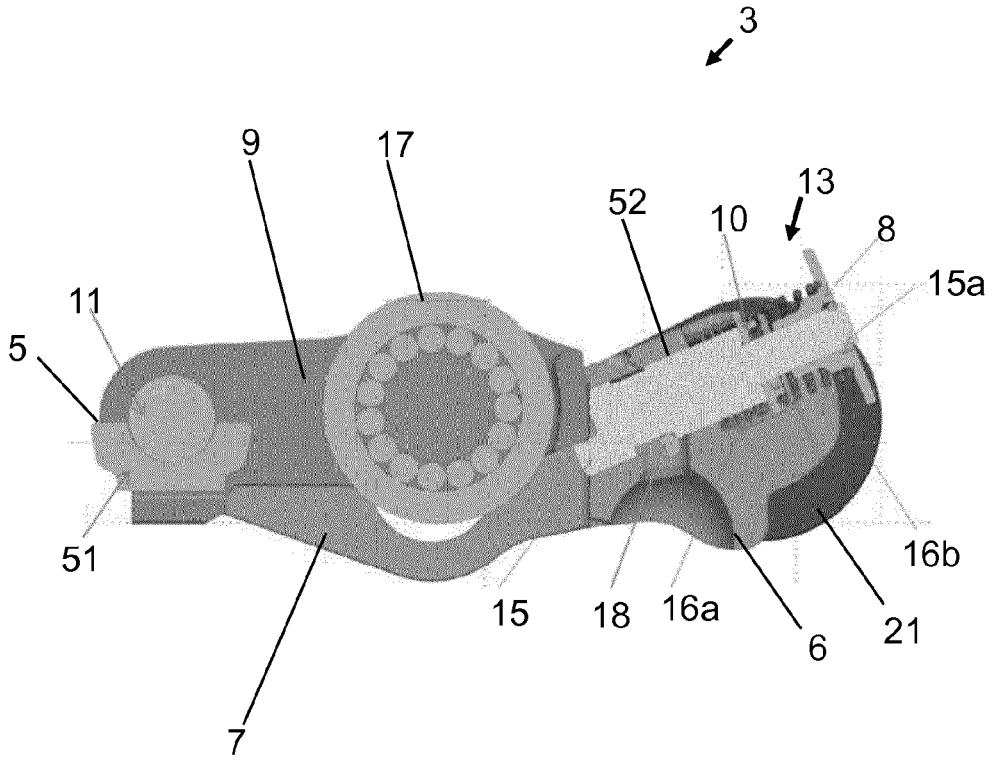
FIG. 2 illustrates schematically a cross section of a rocker arm according to an example.

Referring to FIGS. 1 and 2, a valve train assembly 1 according to a first example comprises a plurality of rocker arms 3 (four are illustrated in FIG. 1) for actuating respective valves 40 of an internal combustion engine, and an actuation apparatus 2 for actuating a latching arrangement 13 of each rocker arm 3. The valves 40 may be, for example, exhaust valves, of a cylinder of an internal combustion engine.

As perhaps best seen in FIG. 2, each rocker arm 3 comprises an outer body 7 and an inner body 9 that are pivotably connected together at a pivot axis 11. A first end of the rocker arm 3 contacts a valve stem 41 (not shown in FIG. 2) of the valve 40 and a second end 6 of the rocker arm 3 contacts a hydraulic lash adjuster (HLA) 42 (not shown in FIG. 2). The HLA 42 compensates for lash in the valve train assembly 1. The outer body 7 is arranged to move or pivot about the HLA 42. The outer body 7 contacts the valve stem 41 (not shown in FIG. 2) via a foot portion 51 attached to the pivot axis 11. The inner body 9 of the rocker arm 3 is provided with an inner body cam follower 17, for example, a roller follower 17 for following a first cam profile on a cam shaft. The outer body 7 is provided with a pair of roller followers 19 (not visible in FIG. 2), in this example, slider pads 19 arranged either side of the roller follower 17 for following a pair of second cam profiles mounted on the cam shaft.

Each rocker arm 3 comprises at the second end 6 of the rocker arm 3 a latching arrangement 13 for latching and unlatching the outer body 7 and the inner body 9. The latching arrangement 13 comprises a latch pin 15 that can be urged between a first position in which the outer body 7 and the inner body 9 are un-latched and hence can pivot with respect to each other about the pivot axis 11 and a latched position (as illustrated in FIG. 2) in which the outer body 7 and the inner body 9 are latched together and hence can move or pivot about the HLA 42 as a single body. Each rocker arm 3 further comprises a return spring arrangement 21 for returning the inner body 9 to its rest position after it is has pivoted with respect to the outer body 7.

When the latching arrangement 13 of a rocker arm 3 is in the latched position (as illustrated in FIG. 2), such that the inner body 9 and the outer body 7 are latched together, that rocker arm 3 provides a first mode of operation (e.g. a first valve lift mode). For example, when the latching arrangement 13 of the rocker arm 3 is in the latched position, and hence the inner body 9 and the outer body 7 are latched together, when the cam shaft rotates such that the lift profile of the first cam profile engages the inner body cam follower 17, the rocker arm 3 may be caused to pivot about the HLA against the valve spring 39, and hence control the valve 40 to open.

When the latching arrangement 13 of a rocker arm 3 is in the un-latched position, such that the inner body 9 and the outer body 7 are unlatched, that rocker arm 3 provides a second mode of operation (e.g. a second valve lift mode). For example, when the latching arrangement 13 of the rocker arm 3 is in the un-latched position, and hence the inner body 9 and the outer body 7 are unlatched, when the cam shaft rotates such that the lift profile of the first cam profile engages the inner body cam follower 17, the inner body 9 is caused to pivot with respect to the outer body 7 about the pivot axis 11 against the return spring arrangement 21, and hence the rocker arm 3 is not caused to pivot about the HLA, and hence the valve 40 does not open.

In such a way, for example, the position of the latching arrangement 13 may be used to control the mode of operation of the rocker arm 3. Depending on the specific arrangement of the rocker arms 3, the camshaft used with the rocker arms 3, and the valves 40 that the rocker arms 3 control, the rocker arms 3 may be switchable (via the latching arrangement 13) to provide, for example, for one or more of cylinder deactivation (CDA), early exhaust valve opening (EEVO), internal exhaust gas recirculation (iEGR), and the like valve lift modes.

The actuation apparatus 2 is for actuating the latching arrangements 13 of the rocker arms 3 of a valve train assembly 1. As illustrated in FIG. 1, the actuation apparatus 2 comprises an elongate shaft 25 that is rotatable by an actuation source 27. The actuation source 17 is a rotary electric motor 27. A drive shaft 27*a* of the electric motor 27 is mechanically connected (in this case fixed) coaxially to the shaft 25, so that rotation of the drive shaft 27*a* of the electric motor 27 results the same rotation of the shaft 25. The orientation of the shaft 25 is fixed relative to the orientation of the drive shaft 27*a*. The motor 27 is controllable to apply a first force to cause the drive shaft 27*a* (and hence the shaft 25) to rotate in a first direction (e.g. clockwise), and controllable to apply a second force to cause the drive shaft 27*a* (and hence the shaft 25) to rotate in a second direction opposite to the first direction (e.g. anticlockwise). More specifically, the motor 27 is a multistep motor 27, i.e. controllable to rotate the drive shaft 27*a* (and hence shaft 25) by one or more specified angles of rotation in either the first direction (e.g. clockwise) or the second direction (e.g. anticlockwise).

The shaft 25 comprises a plurality of selector cams 29 (four as shown in FIG. 1). Each selector cam 29 is for actuating the latching arrangement 13 of a respective one of the plurality of rocker arms 3, so as to latch the first body 9 and the second body 7 of that rocker arm 3 together. Each selector cam 29 comprises a lobe profile 29*a* and a base circle 29*b*. When the rotational orientation of the shaft 25 is such that a lobe profile 29*a* of a selector cam 29 contacts the latching arrangement 13 of a rocker arm 3, the latching arrangement 13 is caused to move into the latched position. Once latched, the latching arrangement 13 is kept latched by the lobe profile 29*a* of the selector cam 29. When the rotational orientation of the shaft 25 is such that a base circle 29*b* of a selector cam 29 contacts the latching arrangement 13 (or there is no contact between the two) the latching arrangement 13 is in the un-latched position.

In such a way, controlling the actuation source 27 to rotate the shaft 25 and hence the selector cams 29 into different orientations allows control of the latched or unlatched state of the latching arrangements 13 of the rocker arms 3, and hence allows for control of the mode of operation of the rocker arms 3. Each selector cam 29 has the same shape, and has the same orientation relative to the shaft 25, such that the latching arrangements 13 of each of the rocker arms 3 may be actuated in common by the actuation apparatus 2.

In one example, as best seen in FIG. 2, the latch pin 15 of the latching arrangement 13 is slidably disposed in a latch pin channel 52, formed in the outer body 7 of the arm 3 at the second end 6 of the rocker arm 3. A stop 18 limits the extent to which latch pin 15 can travel within the channel 52. The latching arrangement 13 comprises a first biasing means (e.g. a coil spring) 16*a* for biasing the latch pin 15 to the unlatched position. The latching arrangement 13 comprises second biasing means (also referred to as a compliance spring) 16*b*. The first spring 16*a* is arranged around the latch pin 15 and contacts at one end a shelf 10 attached to the latch pin 15, and at the other end the outer body 7 of the rocker arm 3. The compliance spring 16*b* is arranged around the latch pin 15 at an end 15*a* distal from the inner body 9. The compliance spring 16*b* at one end contacts the shelf 10 attached to the latch pin 15, and at another end contacts a contact element 8 arranged for reciprocal movement with respect to the latch pin 15, and arranged for contact with the selector cam 29. The compliance spring 16*b* biases the contact element 8 away from the shelf 10 and hence away from the latch pin 15 and towards the selector cam 29.

When the latching arrangement 13 is actuatable (i.e. able to move), the actuation source 27 rotating the shaft 25, causes the lobe profile 29*a* of the selector cam 29 to contact the latching arrangement 13, which causes the latch pin 15 to move against the spring 16*a* from the unlatched position to the latched position immediately.

However, the latching arrangement 13 may be non-actuatable (not able to move) and hence may not be able to be actuated immediately. For example, this may occur because the inner arm 9 is pivoted with respect to the outer arm 7 about the pivot axis 11 because the first cam profile of the cam shaft is engaging the inner body cam follower 17, and hence the latch pin 15 is blocked from moving to the latched position by the inner body 9. In this case, the compliance spring 16*b* is biased (compressed, pre-loaded) if the selector cam 29 attempts to cause the latch pin 15 to move into the latched position at a time when it cannot do so (e.g. because of the relative orientations of the inner 9 and outer 7 arms) so as to then cause the latch pin 15 to move into the latched position when the latch pin 15 becomes free to do so again.

In such a way, the compliance spring 16*b* allows for the control of the actuation source 27 to not necessarily be synchronised with an engine condition, which may otherwise be complicated and expensive and hence inefficient.

Figure 3A:
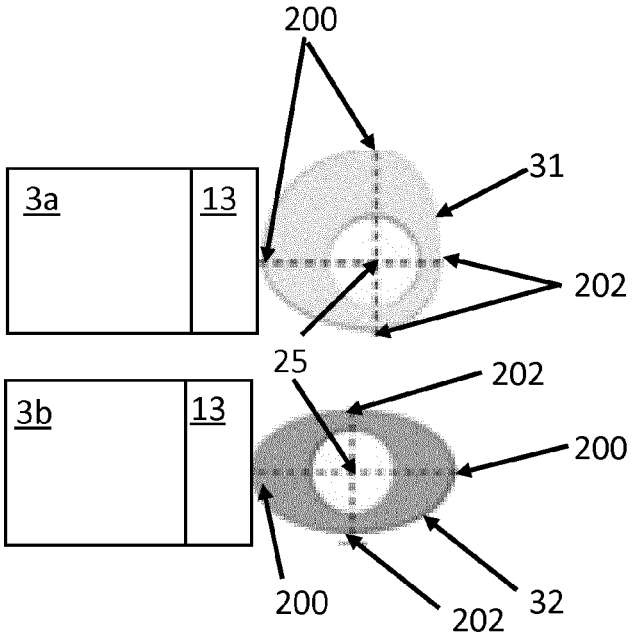
FIG. 3*a* illustrates schematically cross sectional views of differently shaped selector cams according an example.
Figure 3B:
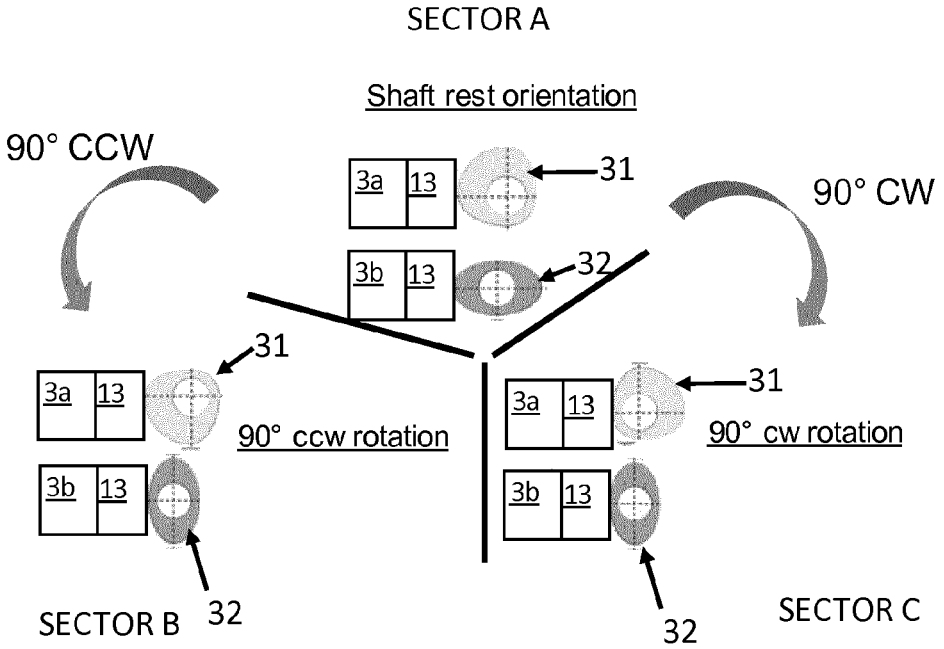
FIG. 3*b* illustrates schematically a flow diagram for different configurations of an actuation apparatus according to the example of FIG. 3*a;*

In another example, illustrated schematically in FIGS. 3*a* and 3*b*, one or more of the selector cams 29 may have a different shape and/or relative orientation with respect to the shaft 25 than another of the selector cams 29. This may allow control of the latching arrangements 13, by the common actuation apparatus 2, on a per rocker arm basis.

Referring to FIGS. 3*a* and 3*b*, there is illustrated an example of differently shaped selector cams 31, 32. The selector cams 31, 32 may be used in place of one or more of the selector cams 29 described above in the first example with reference to FIGS. 1 and 2.

As best seen in FIG. 3*a*, each selector cam 31, 32 comprises one or more lobed portions 200 for applying a force to the respective latching arrangements 13 of a first rocker arm 3*a* and a second rocker arm 3*b*. Each selector cam 31, 32 also comprises a base circle portion 202 for applying substantially no force to (for example not contacting) the respective latching arrangements 13 of the first rocker arm 3*a* and a second rocker arm 3*b*. The first selector cam 31 comprises two such lobed portions 200 arranged substantially at right angles to one another about a rotational axis of the shaft 25. The second selector cam 32 comprises two such lobed portions 200 arranged substantially opposite one another about a rotational axis of the shaft 25. The lobed portions 200 of the second selector cam 32 are substantially parallel to one 200*a* of the two the lobed portions 200 of the first selector cams 31. As best seen in FIG. 3*b*, the different shapes of the selector cams 31, 32 allows, by rotation of the common shaft 25 by the action source 27, individual control of the latched or unlatched position of the latching arrangements 13 of the respective rocker arms 3*a*, 3*b*, i.e. allows control on a per rocker arm basis.

In sector A of the flow diagram of FIG. 3*b*, the drive shaft 27*a* of the actuation source 27 (not shown in FIG. 3*b*), and hence the shaft 25, is in a base position or rest orientation. This rest orientation is nominally assigned an angle of 0°. In the rest orientation, the selector cams 31, 32 are positioned (i.e. rotationally orientated) such that both have a lobed portion 200 aligned with the latching arrangements 13 of the respective rocker arms 3*a*, 3*b*. As a result, both selector cams 31, 32 apply a force to the respective latching arrangements 13 and hence cause the latching arrangements 13 or the first rocker arm 3*a* and the second rocker arm 3*b* to move into the latched position. For example, the rocker arms 3*a* and 3*b* may therefore provide for a first mode of operation (e.g. a first valve lift mode).

Rotation, of the shaft 25 by 90° counter clockwise (CCW) in the sense of FIG. 4*b* from the rest orientation illustrated in sector A results in the orientation of selector cams 31, 32 as shown in sector B. In sector B of the flow diagram of FIG. 3*b*, the first selector cam 31 is positioned (i.e. rotationally orientated) so as to have a lobed portion 200 aligned with the latching arrangement 13 of the first rocker arm 3*a* such that the first selector cam 31 applies a force to the latching arrangement 13, thereby to cause the latching arrangement 13 to move to the latched position. However, the second selector cam 32 is positioned (i.e. rotationally orientated) so as to have a base circle portion 202 aligned with the latching arrangement 13 of the second rocker arm 3*b* (i.e. the lobed portions 200 misaligned with the latching arrangement 13 of the rocker arm 3*b*) such that the second selector cam 32 applies substantially no force to (or does not contact) the latching arrangement 13, and hence allows the latching arrangement 13 of the rocker arm 3*b* to be in the default unlatched position. Therefore, for example, the first rocker arm 3*a* may provide for a first mode of operation (e.g. first valve lift mode), and the rocker arm 3*b* may provide for a second mode of operation (e.g. second valve lift mode).

Rotation of the shaft 25 by 90° clockwise (CW) in the sense of FIG. 4*b* from the orientation as illustrated in sector A results in the orientation of selector cams 31, 32 as shown in sector C. In sector C of the flow diagram of FIG. 4*b*, the selector cams 31, 32 are positioned (i.e. rotationally orientated) such that both have a base circle portion 202 aligned with the respective latching arrangements 13 of the respective rocker arms 3*a*, 3*b* (i.e. both have their respective lobed portions 200 misaligned with the respective latching arrangements 13) such that both selector cams 29, 31 apply substantially no force to (or not contact) the latching arrangement 13 and hence allow the latching arrangements 13 to be in the unlatched position. Therefore, for example, both the first rocker arm 3*a* and the second rocker arm 3*b* a second mode of operation (e.g. second valve lift mode).

The actuation apparatus 23 may comprise a controller arranged to control the rotation of the drive shaft 27*a* of the actuation source 27 thereby to control rotation of the shaft 25. For example, the controller may be arranged to control the actuation source 27 to apply a first force to cause the drive shaft 27*a* (and hence the shaft 25) to rotate in a first direction (e.g. clockwise) by a step of 90° from the rest orientation, and to apply a second force to cause the drive shaft 27*a* (and hence the shaft 25) to rotate in a second direction opposite to the first direction (e.g. anticlockwise) by a step of 90° from the rest orientation. Accordingly, the controller may control rotation of the shaft 25 such that both, one of, or neither of the first cams 31 and second cams 32 apply a force to the latching arrangements 13 of the respective rocker arms 3*a*, 3*b*.

In such a way, the actuation apparatus 2 may allow for individual control of the mode of operation of the rocker arms 3*a*, 3*b*, i.e. allow for control on a per rocker arm basis. It will be appreciated that, for example, a first group of a plurality of rocker arms 3 may be actuated by selector cams having a first shape, for example the first selector cam 31, and a second group of a plurality of rocker arms 3 may be actuated by selector cams having a second, different, shape, for example the second selector cam 32. In this case, the actuation apparatus may allow for individual control of the mode of operation of the first group and the second group of rocker arms 3, i.e. allow for control on a per group basis.

Although not shown in FIGS. 1 to 3*b*, the actuation apparatus 2 comprises a return apparatus 300, 400 for returning the shaft 25 to the rest orientation. A return apparatus 300 according to a first example is illustrated schematically in FIG. 4, and a return apparatus 400 according to a second example is illustrated in FIGS. 5*a* and 5*b*.

In broad overview, return apparatus 300, 400 comprises one or more radial protrusions 302, 402*a*, 402*b* for example protruding radially out from the shaft 25 or the drive shaft 27*a* of the actuation source 27, a reaction body 306, 406 fixed relative to the actuation source 27 (not shown in FIGS. 4 to 5*b*), and a biasing means 304, 404 arranged for contacting the reaction body 306, 406 and for contacting the one or more radial protrusions 302, 402*a*, 402*b*. The return apparatus 300, 400 is arranged such that, in use, when the shaft 25, 27*a* is in the rest orientation (see e.g. sector A of FIG. 3*b*), the biasing means 304, 404 abuts the reaction body 306, 406 such that the biasing means 304, 404 applies substantially no force to the one or more radial protrusions 302, 402. However, when the shaft 25, 27*a* is rotated by the actuation source 27 from the rest orientation in a first direction, the biasing means 304, 404 contacts one or more of the radial protrusions 302, 402 so as to bias the shaft 25, 27*a* rotationally in a second, opposite, direction to towards the rest orientation. Similarly, when the shaft 27*a*, 25 is rotated by the actuation source 27 from the rest orientation in the second direction, the biasing means 304, 404 contacts one or more of the radial protrusions 302, 402 so as to bias the shaft 25, 27*a* rotationally in the first direction to towards the rest orientation.

In such a way, the return apparatus 300, 400 ensures that, for example, when the actuation source 27 ceases to apply a force to cause the shaft 27*a*, 25 to rotate, the shaft 25, 27*a* will return to the rest position, regardless of the direction (sense) of rotation of the shaft 25, 27*a* relative to the rest position. For example, in the case the actuation source 27 is an electric motor 27, the return apparatus 300, 400 ensures that if the electrical current supplied to the electric motor 27 to drive the motor 27 goes to zero, either intentionally or by fault, the shaft 27*a*, 25 will return to the rest orientation by default. The return apparatus 300, 400 may therefore allow for control of the orientation of the shaft 25, 27*a*, and hence (via the selector cams 29, 31, 32 and the latching arrangements 13) the valve lift mode of the rocker arms 3, in the case of default, regardless of the direction (sense) of rotation of the shaft 25, 27*a* relative to the rest position. The return apparatus 300, 400 may therefore improve the reliability and consistency of the performance of the actuation apparatus 2.

Figure 4:
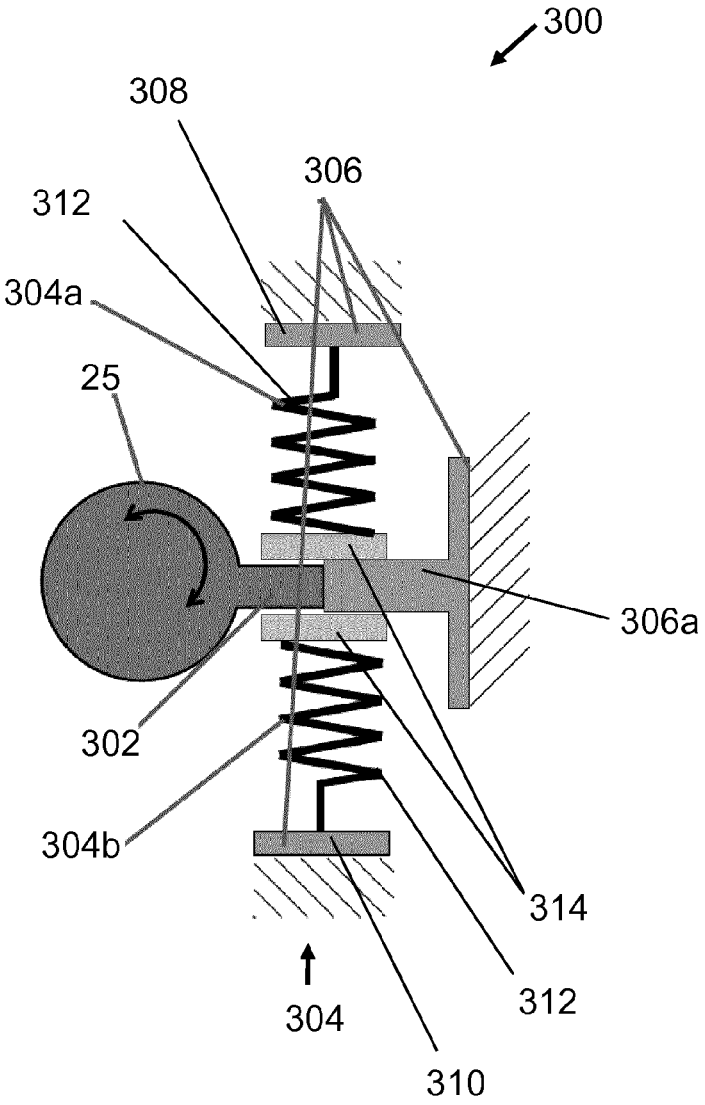
FIG. 4 illustrates schematically a cross section of a return device according to a first example.
Figure 5A:
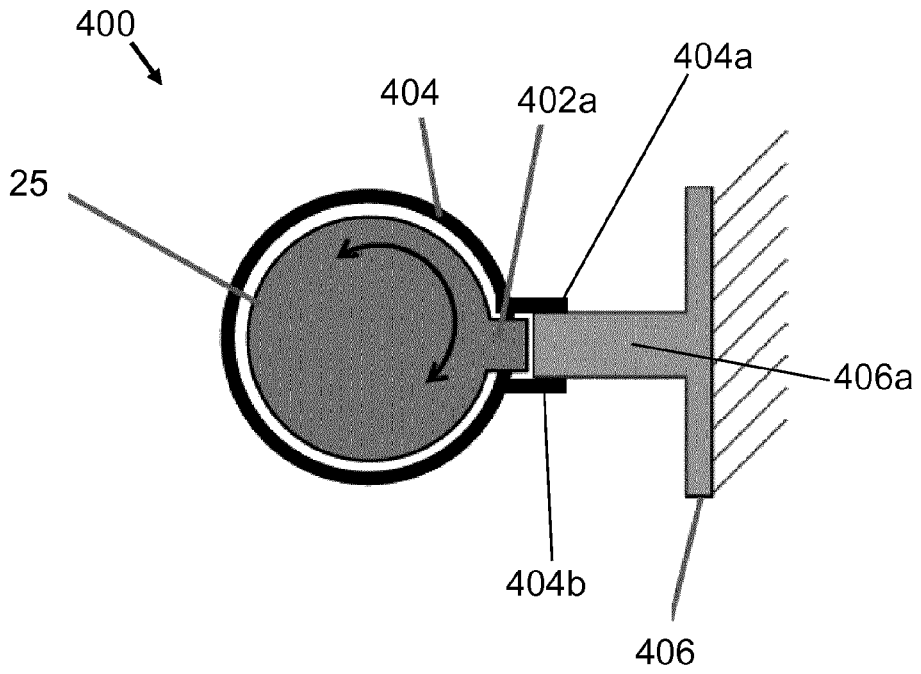
FIG. 5*a* illustrates schematically a cross section of a return device according to a second example.
Figure 5B:
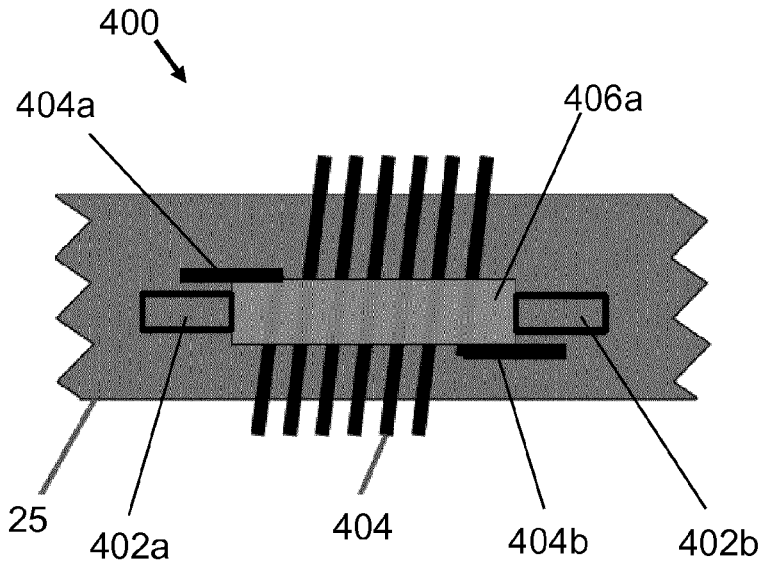
FIG. 5*b* illustrates schematically a side view of the return device of FIG. 5*a*.

Referring now specifically to FIG. 4, the first example return apparatus 300 comprises a radial protrusion 302 protruding radially from the shaft 25 (i.e. the shaft 25 comprising selector cams 29, 31, 32 also comprises the radial protrusion 302). The return apparatus 300 comprises a reaction body 306 fixed relative to the actuation source 27 (not shown in FIG. 4), and a biasing means 304 arranged for contacting the reaction body 306 and for contacting the radial protrusion 302.

The biasing means 304 comprises a first biasing element 304*a* and a second biasing element 304*b* separate from the first biasing element 304*a*. The radial protrusion 302 of the shaft 25 is located intermediate of the first biasing element 304*a* and the second biasing element 304*b*. The first and second biasing elements 304*a*, 304*b* are arranged substantially co-linearly. The first biasing element 304*a* is arranged to bias the radial protrusion 302 away from a first portion 308 of the reaction body 306 and the second biasing element 304*b* is arranged to bias the radial protrusion 302 away from a second portion 310 of the reaction body 306 located substantially opposite to the first portion 308 of the reaction body 306.

The reaction body 306 comprises a reaction member 306*a* located intermediate of the first biasing element 304*a* and the second biasing element 204*b*. The first biasing element 304*a* and the second biasing element 304*b* each comprise a compression spring 312 and a pad 314 for contacting the radial protrusion 302 and for contacting the reaction member 306*a*. When the shaft 25 is in the rest orientation, the radial protrusion 302 is aligned with (i.e. lies adjacent to and substantially in the same plane as) the reaction member 306*a*.

The reaction member 306*a* extends only part way across the pad 314 of each biasing element 304*a*, 304*b*. Similarly, the radial protrusion 302 extends only part way across the pad 314 of each biasing element 304*a*, 304*b*. The reaction member 306*a* has a thickness equal to or greater than the thickness of the radial protrusion 302. Accordingly, a separation, in a plane perpendicular to the axis of the shaft 25, between the first biasing element 304*a* and the second biasing element 304*b* when the shaft is in the rest orientation is substantially equal to or greater than a thickness of the radial protrusion 302 in a plane perpendicular to the axis of the shaft.

When the shaft 25 is in the rest orientation, the first biasing element 304*a* and the second biasing element 304*b* abut the reaction member 306*a* such that both the first biasing element 304*a* and the second biasing element 304*b* apply substantially no rotational force to the shaft 25. However, when the shaft is rotated 25 in either the first or the second direction (i.e. clockwise or anticlockwise) by the actuation source 27 from the rest position, the radial protrusion 302 clears the reaction member 306*a* and engages either the first 304*a* or the second 304*b* biasing element. For example, when the shaft 25 is rotated from the rest orientation in a first direction (e.g. anticlockwise in the sense of FIG. 4) the first biasing element 304*a* contacts the radial protrusion 302 so as to bias the shaft rotationally in a second, opposite, direction (e.g. clockwise in the sense of FIG. 4) towards the rest orientation, and when the shaft 25 is rotated from the rest orientation in the second direction (e.g. clockwise in the sense of FIG. 4) the second biasing means 304*b* contacts the radial protrusion 302 so as to bias the shaft 25 rotationally in the first direction (e.g. anticlockwise in the sense of FIG. 4) towards the rest orientation. The return apparatus 300 may therefore help ensure that the shaft 25 is kept as default in the rest orientation regardless of a direction of rotation of the shaft 25 from the rest position, and hence may therefore improve the reliability and consistency of the performance of the actuation apparatus 2, hence the control of the modes of operation of the rocker arms 3.

Referring now to FIGS. 5*a* and 5*b*, the second example return apparatus 400 comprises two radial protrusions 402*a* and 402*b* protruding radially from the shaft 25 (i.e. the shaft 25 comprising selector cams 29, 31, 32 also comprises two radial protrusion 402*a*, 402*b*). The radial protrusions 402*a*, 402*b* are separated from one another axially along the shaft 25. The return apparatus 400 comprises a reaction body 406, comprising a reaction member 406*a*, fixed relative to the actuation source 27 (not shown in FIG. 5*a* or 5*b*), and a biasing means 404 arranged for contacting the reaction member 406*a* and for contacting the radial protrusions 402*a*, 402*b*.

The biasing means 404 is a torsional biasing means or torsional spring 404. The torsional biasing means 404 is arranged around the shaft 25. End portions 404*a*, 404*b* of the torsional biasing means 404 extend in a direction substantially parallel with the axis of the shaft 25. A first end portion 404*a* of the torsional biasing means 404 is for contacting the reaction member 406*a* of the reaction body 406 and for contacting a first radial protrusion 402*a*. A second end portion 404*b* of the torsional biasing means 404 is for contacting the reaction member 406*a* and the second radial protrusion 402*b*. As best seen in FIG. 5*a*, the reaction member 406*a* is located intermediate of the first end 404*a* of the torsional biasing means 404 and the second end 404*b* of the torsional biasing means 404. As best seen in FIG. 5*b*, the reaction member 406*a* is located intermediate of the first radial protrusion 402*a* and the second radial protrusion 402*b*, axially along the shaft 25. When the shaft 25 is in the rest orientation (as shown in FIGS. 5*a* and 5*b*), the radial protrusions 402*a*, 402*b* are aligned with (i.e. lie adjacent to and substantially in the same plane as) the reaction member 406*a*.

As best seen in FIG. 5*b*, the reaction member 406*a* extends only part way along the length of the first end portion 404*a* of the torsional biasing means 404, and extends only part way along the length of the second end portion 404*b* of the torsional biasing means 404. Similarly, the first radial protrusion 406*a* extends only part way along the first end portion 404*a* of the torsional biasing means 404, and the second radial protrusion 406*b* extends only part way along the second end portion 404*b* of the torsional biasing means 404. The reaction member 406*a* has a thickness equal to or greater than the thickness of the first radial protrusion 402*a* and of the second radial protrusion 402*b*. Specifically, a thickness of the reaction member 406*a* in a plane perpendicular to the axis of the shaft 25 is substantially equal to or greater than the thickness of the radial protrusions 402*a*, 402*b* in a plane perpendicular to the axis of the shaft 25.

When the shaft 25 is in the rest orientation, the first end portion 404*a* of the torsional biasing means 404 and the second end portion 404*b* of the torsional biasing means 404 abut the reaction member 406*a* such that the torsional biasing means 404 applies substantially no force to either the first radial protrusion 402*a* or the second radial protrusion 402*b*. However, when the shaft 25 is rotated from the rest orientation in a first direction (e.g. anticlockwise in the sense of FIG. 5*a* and when looking down the shaft 25 from the left in the sense in FIG. 5*b*) the first end portion 404*a* of the torsional biasing means 404 contacts the first radial protrusion 402*a* so as to bias the shaft rotationally in the second direction (e.g. clockwise in the sense of FIG. 5*a*) towards the rest orientation, and when the shaft 25 is rotated from the rest orientation in the second direction (e.g. clockwise in the sense of FIG. 5*a* and when looking down the shaft 25 from the left in the sense in FIG. 5*b*) the second end portion 404*b* of the torsional biasing means 404 contacts the second radial protrusion 402*b* so as to bias the shaft 25 rotationally in the first direction (e.g. anticlockwise in the sense of FIG. 5*a*) towards the rest orientation. The return apparatus 400 may therefore help ensure that the shaft 25 is kept by default in the rest orientation regardless of the direction (sense) of rotation of the shaft from the rest position, and hence may therefore improve the reliability and consistency of the performance of the actuation apparatus 2, and hence the control of the modes of operation of the rocker arms 3.

Although in the above examples it is described that when the shaft is in the rest orientation the biasing means 304, 404 abuts the reaction body 306, 406 such that the biasing means 304, 404 applies substantially no net force to the shaft 25, 27*a* through the one or more radial protrusions 302, 402*a*, 402*b*, it will be appreciated that this need not necessarily be the case. For example, in the above examples, the thickness of the reaction member 306*a*, 406*a* in a plane perpendicular to the axis of the shaft 25 is described as being substantially equal to or greater than the thickness of the one or more radial protrusions 302, 402*a*, 402*b* in a plane perpendicular to the axis of the shaft 25. However, in other examples that are not illustrated, the thickness of the reaction member 306*a*, 406*a* in a plane perpendicular to the axis of the shaft 25 may be less than the thickness of the one or more radial protrusions 302, 402*a*, 402*b* in a plane perpendicular to the axis of the shaft 25. In these other examples, it will be appreciated that the return apparatus 300, 400 may instead be arranged such that, when the shaft 25 is in the rest orientation the biasing means 304, 404 abuts the one or more radial protrusions 302, 402*a*, 402*b* such that the biasing means 304, 404 applies substantially no net force to the reaction body 306, 406.

One example may be similar to the example of FIG. 4, except that the thickness of radial protrusion 302 is greater than the thickness of the reaction member 306*a*. In this example, when the shaft 25 is in the rest orientation, the first biasing means 304*a* and the second biasing means 304*a* may apply substantially equal and opposite forces to the radial protrusion 302 (and no net force to the reaction member 306*a*), and hence in the rest orientation the biasing means 304 may apply substantially no net force to the radial protrusion 302, and hence no rotational force to the shaft 25. However, when the shaft 25 is rotated in the first direction (e.g. anticlockwise) from the rest orientation, the first biasing means 304*a* may continue to apply a force to the radial protrusion 302, but the second biasing means 304*b* may abut the reaction member 306*a* and hence apply no force to the radial protrusion 302, and hence the biasing means 304 may bias the shaft 25 in the second direction towards the rest orientation. Similarly, when the shaft 25 is rotated in the second direction (e.g. clockwise) from the rest orientation, the second biasing means 304*a* may continue to apply a force to the radial protrusion, but the first biasing means 304*b* may abut the reaction member 306*a* and hence apply no force to the radial protrusion 302, and hence the biasing means 304 applies biases the shaft 25 in the first direction towards the rest orientation.

Another example may be similar to the example of FIG. 5, except that the thickness of radial protrusions 402*a*, 402*b* are greater than the thickness of the reaction member 406*a*. In this example, when the shaft 25 is in the rest orientation, the first end 404*a* and the second end 404*b* of the torsional biasing means 404 may apply substantially no net force to the radial protrusions 402*a*, 402*b*, (i.e. substantially no resultant force that would cause the radial protrusions 402*a*, 402*b* or the shaft 25 to move), and no force to the reaction member 406*a*. Hence in the rest orientation the biasing means 404 may apply substantially no rotational force to the shaft 25, and hence the shaft 25 may remain in the rest orientation in default. However, when the shaft 25 is rotated in the first direction (e.g. anticlockwise) from the rest orientation, the first end 404*a* may apply a force to the radial protrusion 402*a*, but the second end 404*b* may abut the reaction member 406*a* and hence apply no force to the radial protrusion 402*b*, and hence the biasing means 404 may bias the shaft 25 in the second direction towards the rest orientation. Similarly, when the shaft 25 is rotated in the second direction (e.g. clockwise) from the rest orientation, the second end 404*b* may apply a force to the radial protrusion 404*b*, but the first end 404*a* abuts the reaction member 406*a* and hence applies no force to the radial protrusion 402*a*, and hence the biasing means 304 biases the shaft 25 in the first direction towards the rest orientation.

In each of the described examples, the return apparatus 300, 400 is arranged such that, in use, when the shaft 25 is in the rest orientation the biasing means 304, 404 applies substantially no rotational force to the shaft 25. However, when the shaft 25 is rotated from the rest orientation in the first direction the biasing means 304, 404 contacts the reaction body 306, 406 and one or more of the radial protrusions 302, 402*a*, 402*b* so as to bias the shaft 25 rotationally in the second direction to towards the rest orientation, and when the shaft 25 is rotated from the rest orientation in the second direction the biasing means 304, 404 contacts the reaction body 306, 406 and one or more of the radial protrusions 302, 402*a*, 402*b* so as to bias the shaft 25 rotationally in the first direction to towards the rest orientation. In such a way, the return apparatus 300, 400 may help ensure that the shaft 25 is returned to the rest orientation in default.

Although in the above examples of return apparatus 300, 400, the radial protrusion 302 or radial protrusions 402*a*, 402*b* were of the shaft 25 comprising the selector cams 29, 31, 32, it will be appreciated that this need not necessarily be the case, and that in other examples, the radial protrusions 302, 402*a*, 402*b* may instead be of the drive shaft 27*a* of the actuation apparatus 27, or indeed any other shaft that may be caused by the actuation source 27 to rotate, and by which the selector cams 29, 31, 32 are rotatable. For example, the return apparatus 300, 400 may be integral with actuation source 27, for example an electric motor 27. In other examples, the return apparatus may be separate from the actuation source 27, for example implemented at a location along the drive shaft 27*a* or shaft 25 away from the actuation source 27.

Although in the above examples the actuation source 27 is an electric motor 27, this need not necessarily be the case and in other examples the actuation source 27 may be or comprise any type of motor such as a hydraulic motor.

It will be appreciated that in some examples selector cam shapes other than those described above with reference to FIGS. 1 or FIGS. 3*a* and 3*b* may be used provide the control of the latching arrangement 13 of the rocker arms 3.

It will be appreciated that the rocker arms 3 may be configurable (switchable, controllable) to provide for any functions or modes of operation. Indeed, the rocker arms 3 may be any rocker arm comprising a first body, a second body mounted for pivotal motion with respect to the first body, and a latching arrangement for latching and unlatching the first body and the second body. For example, in some examples the slider pads 19 of the rocker arms 3 may be replaced by cam followers and the second cam profiles may include lift profiles, such that one or more of the rocker arms 3 may provide for a first valve lift mode when the latching arrangement 13 is in the latched position and a second valve lift mode when the latching arrangement 13 is in the unlatched position. In such a way, for example, other functionality such as, for example, (switchable) internal Exhaust Gas Recirculation (iEGR) and/or (switchable) early exhaust valve opening (EEVO) may be provided by the rocker arms 3.

Although in some of the above examples the default position of the latching arrangement was described as unlatched and that the latching arrangement 13 is actuated from an unlatched position to a latched position, this need not necessarily be the case and in some examples, the default position of the latching arrangement 13 may be latched, and the actuation apparatus 2 may be arranged to cause the latching arrangement 13 to move from the latched position to the unlatched position. Indeed, the actuation apparatus 2 may be arranged to move the respective latching arrangements 13 of one or more rocker arms 3 from one of the latched and unlatched positions to the other of the latched and unlatched positions.

It is to be understood that any feature described in relation to any one example may be used alone, or in combination with other features described, and may also be used in combination with one or more features of any other of the examples, or any combination of any other of the examples.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SIGNS LIST

1 valve train assembly
2 actuation apparatus
3, 3*a*, 3*b* rocker arm
5 first end of rocker arm
6 second end of rocker arm
7 outer arm
8 contact element
9 inner arm
10 shelf
11 pivot axis
13 latching arrangement
15 latch pin
15*a* end of latch pin
16*a* first spring
16*b* compliance spring
17 inner body cam follower
18 stop
19 roller followers
21 return spring arrangement
25 shaft
27 actuation source
27*a* drive shaft
29 selector cam
29*a* lobe profile
29*b* base circle
31 first selector cam
32 second selector cam
39 valve spring
40 valve
41 valve stem
42 hydraulic lash adjuster (HLA)
51 foot portion
52 latch pin channel
200 lobed portion
202 base circle portion
300 return apparatus
302 radial protrusion
304 biasing means
304*a* first biasing element
304*b* second biasing element
306 reaction body
306*a* reaction member
308 first portion of reaction body
310 second portion of reaction body
312 compression spring
400 return apparatus
402*a* first radial protrusion
402*b* second radial protrusion
404 biasing means
404*a* first end portion
404*b* second end portion
406 reaction body
406*a* reaction member

The invention claimed is:

1. An apparatus for actuating one or more latching arrangements of one or more respective rocker arms of a valve train assembly of an internal combustion engine, each rocker arm comprising a first body, a second body for pivotal motion with respect to the first body, and the latching arrangement, the latching arrangement being configured to latch and unlatch the first body and the second body, the apparatus comprising:

a shaft rotatable by an actuation source, from a rest orientation, in a first direction, and rotatable by the actuation source, from the rest orientation, in a second direction opposite the first direction;

one or more selector cams rotatable by the shaft, each selector cam for being configured to actuate the latching arrangement of a respective rocker arm so as to latch and/or unlatch the first body and the second body; and a return apparatus configured to return the shaft to the rest orientation, the return apparatus comprising:

one or more radial protrusions protruding radially out from the shaft;

a reaction body; and a biasing means configured to contact the reaction body and the one or more radial protrusions;

wherein the return apparatus is configured such that, in use:

when the shaft is in the rest orientation the biasing means is configured to apply substantially no rotational force to the shaft, when the shaft is rotated from the rest orientation in the first direction the biasing means is configured to contact the reaction body and one or more of the radial protrusions so as to bias the shaft rotationally in the second direction to towards the rest orientation, and when the shaft is rotated from the rest orientation in the second direction the biasing means is configured to contact the reaction body and one or more of the radial protrusions so as to bias the shaft rotationally in the first direction to towards the rest orientation.

2. The apparatus according to claim 1, wherein the return apparatus is configured such that when the shaft is in the rest orientation the biasing means abuts the reaction body such that the biasing means applies substantially no net force to the shaft through the one or more radial protrusions.

3. The apparatus according to claim 1, wherein the return apparatus is configured such that when the shaft is in the rest orientation the biasing means abuts the one or more radial protrusions, such that the biasing means applies substantially no net force to the reaction body.

4. The apparatus according to claim 1, wherein the shaft comprises the one or more selector cams.

5. The apparatus according to claim 1, wherein the shaft comprises a drive shaft of the actuation source.

6. The apparatus according to claim 2, wherein the biasing means comprises a torsional biasing means.

7. The apparatus according to claim 6, wherein the torsional biasing means is arranged around the shaft, a first end portion of the torsional biasing means is configured to contact the reaction body and at least one of the radial protrusions, and a second end portion of the torsional biasing means is configured to contact the reaction body and the at least one or another of the radial protrusions.

8. The apparatus according to claim 7, wherein the reaction body comprises a reaction member located intermediate of the first end portion of the torsional biasing means and the second end portion of the torsional biasing means.

9. The apparatus according to claim 8, wherein the apparatus is configured such that when the shaft is in the rest orientation the first end portion of the torsional biasing means and the second end portion of the torsional biasing means abut the reaction member such that the torsional biasing means applies substantially no force to the one or more radial protrusions.

10. The apparatus according to claim 9, wherein a thickness of the reaction member in a plane perpendicular to an axis of the shaft is substantially equal to or greater than a thickness of the one or more radial protrusions in a plane perpendicular to the axis of the shaft.

11. The apparatus according to claim 1, wherein the biasing means comprises a first biasing element and a second biasing element separate from the first biasing element, the first biasing element and the second biasing element each being configured to contact the reaction body and to contact the one or more radial protrusions such that, in use, when the shaft is rotated from the rest orientation in the first direction the first biasing element applies a force to one or more of the radial protrusions so as to bias the shaft rotationally in the second direction to towards the rest orientation, and when the shaft is rotated from the rest orientation in the second direction the second biasing element applies a force to one or more of the radial protrusions so as to bias the shaft rotationally in the first direction to towards the rest orientation.

12. The apparatus according to claim 11, wherein the one or more radial protrusions are located intermediate of the first biasing element and the second biasing element.

13. The apparatus according to claim 11, wherein the reaction body comprises a reaction member located intermediate of the first biasing element and the second biasing element.

14. The apparatus according to claim 13, wherein the apparatus is configured such that when the shaft is in the rest orientation the first biasing element and the second biasing element abut the reaction member such that both the first biasing element and the second biasing element apply substantially no rotational force to the shaft.

15. The apparatus according to claim 14, wherein the reaction member is configured such that a separation, in a plane perpendicular to an axis of the shaft, between the first biasing element and the second biasing element when the shaft is in the rest orientation is substantially equal to or greater than a thickness of the one or more radial protrusions in a plane perpendicular to the axis of the shaft.

16. The apparatus according to claim 13, wherein the first biasing element and the second biasing element each comprise a pad configured to contact the one or more the radial protrusions and for contacting the reaction member, and wherein when the shaft is in the rest orientation, the reaction member extends only part way across the pad of each biasing element, and the one or more radial protrusions extend only part way across the pad of each biasing element.

17. The apparatus according to claim 1, wherein the apparatus comprises a plurality of the selector cams, each configured to actuate the latching arrangement of a respective different the rocker arm of a plurality of the rocker arms.

18. The apparatus according to claim 17, wherein each of the plurality of selector cams have a different shape so as to allow control of the latching arrangements on a per rocker arm basis.

19. A valve train assembly for an internal combustion engine, the valve train assembly comprising:

the apparatus according to claim 1;

the actuation source; and the rocker arm or the plurality of rocker arms.

* * * * *